US010577727B2

(12) United States Patent
Xia et al.

(10) Patent No.: US 10,577,727 B2
(45) Date of Patent: Mar. 3, 2020

(54) RING COMPOSITE SPINNING METHOD BASED ON FILM FILAMENTIZATION

(71) Applicant: Wuhan Textile University, Wuhan, Hubei (CN)

(72) Inventors: Zhigang Xia, Hubei (CN); Xin Liu, Hubei (CN); Cailing Ding, Hubei (CN); Weilin Xu, Hubei (CN)

(73) Assignee: Wuhan Textile University, Wuhan, Hubei (CN)

( * ) Notice: Subject to any disclaimer, the term of this patent is extended or adjusted under 35 U.S.C. 154(b) by 93 days.

(21) Appl. No.: 15/936,439

(22) Filed: Mar. 27, 2018

(65) Prior Publication Data

US 2018/0216257 A1 Aug. 2, 2018

(30) Foreign Application Priority Data

May 11, 2017 (CN) ..... 2017 1 0329919

(51) Int. Cl.
*D01H 1/02* (2006.01)
*D01D 5/42* (2006.01)
(Continued)

(52) U.S. Cl.
CPC ..... *D01H 1/02* (2013.01); *D01D 5/426* (2013.01); *D02G 3/047* (2013.01); *D02G 3/06* (2013.01);
(Continued)

(58) Field of Classification Search
CPC ..... D01D 5/426; D01D 5/16; D01D 5/42; D01D 5/423; D01D 10/02; B26D 1/22;
(Continued)

(56) References Cited

U.S. PATENT DOCUMENTS 2,312,173 A * 2/1943 Johnstone ..... B26D 1/225 83/469
3,264,816 A * 8/1966 Jaggi ..... D02G 3/324 57/12
(Continued)

FOREIGN PATENT DOCUMENTS

CA 910032 * 9/1792 ..... B26D 1/225
GB 1233713 A * 5/1971 ..... D01D 5/423

*Primary Examiner* — Shaun R Hurley
*Assistant Examiner* — Patrick J. Lynch

(57) ABSTRACT

A ring composite spinning method based on film filamentization is provided, which belongs to a textile technical field. According to the method, a film cutting drafting device is arranged above each drafting system on a ring spinning machine for cutting film material into ribbon-shaped multi-filaments to achieve the film filamentization, which changes a conventional formation of filament through linear spraying by spinneret orifices; then the multi-filaments formed pass through first and second filament drafting zones in sequence for drawing, so as to enhance and attenuate the multi-filaments. After in drawing, the multi-filaments are twisted with conventional staple fibers to form a composite yarn with high quality and functions, achieving one-step production of composite yarns of nano-micro fibers without online combination of nanofibers spinning and ring staple spinning, thereby breaking restriction of "low bulk and low-speed production of nano-spun fibers" and integrating film industry with textile industry.

3 Claims, 2 Drawing Sheets

(51) Int. Cl.

| | |
|---|---|
| ***D02G 3/04*** | (2006.01) |
| ***D02G 3/06*** | (2006.01) |
| *D01D 5/16* | (2006.01) |

(52) U.S. Cl.
CPC ..... *D01D 5/16* (2013.01); *D10B 2201/02* (2013.01); *D10B 2331/021* (2013.01)

(58) Field of Classification Search
CPC ..... B26D 1/225; D02G 3/06; D02G 3/02; D01G 1/06; D01H 13/28; D01H 1/02; D01H 1/006; D01H 7/90; D01H 7/86; D01H 7/88
USPC ..... 57/260, 75, 31
See application file for complete search history.

(56) References Cited

U.S. PATENT DOCUMENTS

| | | | | | |
|---|---|---|---|---|---|
| 3,596,459 | A * | 8/1971 | Wada | D02G 3/367 | 57/6 |
| 3,596,816 | A * | 8/1971 | Brown | D01D 5/423 | 225/2 |
| 4,697,407 | A * | 10/1987 | Wasserman | D01D 5/42 | 428/372 |
| 4,845,813 | A * | 7/1989 | Salaun, Jr. | D01H 5/22 | 19/258 |
| 7,841,162 | B2 * | 11/2010 | Coombs | D02G 3/38 | 57/210 |
| 2007/0243378 | A1 * | 10/2007 | Cho | D01D 5/16 | 428/375 |
| 2012/0151894 | A1 * | 6/2012 | Tao | D01H 1/11 | 57/75 |
| 2015/0184319 | A1 * | 7/2015 | Yeung | D01H 1/025 | 428/221 |

* cited by examiner

RING COMPOSITE SPINNING METHOD BASED ON FILM FILAMENTIZATION

CROSS REFERENCE OF RELATED APPLICATION

The application claims priority under 35 U.S.C. 119(a-d) to CN 201710329919.9, filed May 11, 2017.

BACKGROUND OF THE PRESENT INVENTION

Field of Invention

The present invention relates to a textile technical filed, and more particularly to a ring composite spinning method based on film filamentization.

Description of Related Arts

The textile fibers can be divided into natural fibers and chemical fibers by source; and the chemical fibers generally include regenerated fibers and synthetic fibers. Because the natural macromolecules already existing in the natural world fail to meet the requirements of the textile processing due to the features such as the length and thickness of the macroscopic aggregation morphology, the natural macromolecules need to be re-aggregated into a fibrous form through a chemical method to meet the textile processing requirements and form the regenerated fibers, such as the regenerated cellulose fibers and various viscose fibers. The synthetic fibers are formed with raw materials of petrochemical micromolecules successively through steps of: chemically synthesizing the micromolecules into macromolecules; and processing into chemical filaments through a spinning process. According to the performance of the macromolecular materials, the production of the chemical filaments can be divided into melting spinning and solution spinning. The melting spinning is applicable to the macromolecular materials having the obvious hot melting point and the melting temperature lower than the decomposition temperature, and the process thereof comprises steps of: preparing a spinning melt (including melt slicing, melt drying, etc.); feeding the spinning melt into a twin-screw extrusion high-temperature melt spinning machine, and heating the spinning melt into hot melt liquid; extruding the hot melt liquid from the spinneret orifices; processing the melt stream with stretching and solidification; conditioning and oiling; and winding. The as-spun filaments formed through winding are generally the multi-filaments containing at least hundreds of mono-filaments, which cannot be directly applied in the textile processing and generally need to be further processed with dividing, secondary hot drafting and forming, post-processing such as false twisting or air texturing, and winding. After the post-processing, the linear assembled as-spun filaments with cylindrical cross-section shape can be used for a variety of composite spinning. It can be seen that: the filaments processed with the melt spinning require a complex process to be applied in the texture fiber processing with the long process flow and the low production efficiency. The solution spinning is applicable to the macromolecular materials without the obvious hot melting point, or with the melting temperature higher than the decomposition temperature. The solution spinning process comprises steps of: dissolving the polymers in the spinning solution prepared with an appropriate solvent; filtering, defoaming and mixing, and thereafter placing the spinning solution in the solution tank of the solution spinning machine; under the high-pressure push effect, pressing the spinning solution out of the spinneret orifices and into the coagulation bath to be coagulated into the as-spun filament fibers (wherein the coagulation can be divided into the wet method and the dry method according to the different coagulation baths), and obtaining the as-spun filaments; processing the as-spun filaments with stretching and solidifying; washing the as-spun filaments to remove the attached coagulation bath liquid and solvent; conditioning and oiling; and winding. The as-spun filaments formed through winding are generally the multi-filaments containing at least hundreds of mono-filaments, which cannot be directly applied in the textile processing and generally need to be further processed with dividing, secondary hot drafting and forming, post-processing such as false twisting or air texturing, and winding. The cross-section of the filament is adjustable according to the shape of the spinneret orifices for forming the as-spun filament fibers of various shapes. After the post-processing, the linear assembled as-spun filaments with cylindrical cross-section shape can be used for a variety of composite spinning. It can be seen that: the filaments processed with the solution spinning require a complex process to be applied in the texture fiber processing with the long process flow and the low production efficiency. Therefore, conventional filament fiber formation generally employs spinneret orifices to perform linear extruding fiber forming, which requires long process flow and complex equipment.

With the technology development of the textile materials and the higher and higher demands of the people on the clothing materials and styles, the requirements on the spinning technology is higher and higher. Various spinning methods emerge in endlessly, such as the sirofil spinning, the siro spinning, the compact spinning, the cable spinning, the core spinning and the embedded spinning. The above spinning methods greatly enrich the spinning processing means, and obviously increase the quality of the resultant spun yarn. The spinning methods, such as the sirofil spinning, the embedded spinning and the core spinning, relate to the staple fibers and the filament fibers, belonging to the category of ring filament composite spinning. The sirofil spinning is to feed one filament and one roving strand with a certain spacing, so that the filament and the staple fiber strand are twisted with each other to form a sirofil spun yarn. The core spinning is to feed one filament from the center of one or two roving strands, so as to realize the composite yarn structure with the staple fibers as the sheath and the filaments as the core. The embedded spinning is to feed two filaments with a certain spacing into the front roller nip and then feed two strands with a certain spacing symmetrically into the front roller nip, so that one filament and the strand at the same side are twisted with each other to form a pre-twisted composite strand and afterwards join with the other pre-twisted composite strand to conduct a convergence twisting, so as to form an embedded composite yarn with a complex structure. However, the above composite spinning method requires that the positions of the filaments and the staple fiber strands are fixed and invariant relatively, so that the positions of the filaments are fixed with respect to the positions of the staple fibers in the obtained composite yarn structure, resulting in that the filaments cannot perform abundant migrations within the composite yarn body maximumly, so that the filaments cannot mix and cohere with the staple fibers within the yarn body naturally and uniformly. Moreover, the used multi-filaments are well formed after industrialized stretching, shaping and winding and are in a package form, wherein the multi-filaments are aggregated into a linear shape like a cylinder and the mono-filaments in the multi-filaments fail to effectively disperse into the staple fiber strands. Thus, all the composite yarn produced with the above composite spinning methods has the problems that the cohesion force between the filaments and the staple fibers is not enough and the relative sliding between the filaments and the staple fibers in the subsequent processing easily occurs, leading to the low spinning efficiency and the poor cloth cover quality and fabric abrasive resistance. In order to solve the problem of the relatively poor cohesion force between the filaments and the staple fibers in the composite spinning, the Chinese patent publication of CN100523340C, published on Aug. 5, 2009, "Filament composite yarn and production method thereof grey cloth and fabric with filament composite yarn, and fiber opening device for composite spinning", disclosed a production method of the long-short composite yarn in the ring spinning machine. The production method is to process the synthetic fiber multifilament with electrical fiber opening, so as to enable the multi-filaments to enter the front roller nip for being processed together with the staple fiber strands via the composite spinning twisting. Each mono-filament in the multi-filaments is fiber-opened into a hashed fibrous shape, which is able to greatly increase the distribution of each mono-filament in the composite yarn section and enhance the cohesion force between the filaments and the staple fibers. However, the above method adopts the electrical fiber opening, which has the high cost, has the potential danger of fire due to the electrostatic spark in the production process, and thus does not have the practical application and generalization performance in the factory. Moreover, the method directly adopts the package form with good forming after industrialized stretching, shaping and winding, without shortening the entire industrial chain and flow of the composite yarn production using the filaments and the staple fibers.

The above is the problems existing in the conventional filament fiber forming method, process and performance as well as the problems in the composite yarn spinning with chemical filaments and the common staple fibers. With the continuous development of the fibrous materials in the application technology of various fields, the nanofiber material has become the hot issue in the research and the function application. The nanofiber material has a diameter in a range of 1-100 nm and has the performance advantages such as the high porosity, high specific surface area, high length-diameter ratio, high surface energy and high activity, reflecting the excellent strengthening, anti-bacteria, water-repellency and filtering functions. The nanofiber material can be applied in various fields such as separation and filtering, biomedical treatment, energy material, polymer reinforcement and photoelectric sensing. With the extension and requirements of the application fields of the nanofibers, the forming and preparation technology of the nanofibers have been further developed and innovated. So far, the preparation methods of the nanofibers mainly comprise the chemical method, the phase separation method, the self-assembly method and the spinning processing method. The spinning processing method is considered as the most promising method potential in the large-scale preparation of the polymer nanofibers, including the electrostatic spinning method, the two-component composite spinning method, the melt-blowing method and the laser stretching method. The laser ultrasonic stretching method utilizes the laser radiation to heat the fibers and meanwhile processes the fibers with stretching under the ultrasonic condition, generating the stretching ratio of 105 times for preparing the nanofiber strands, which is a method of post-processing common filaments. In addition, the other nano spinning methods are all directly related to the spinneret orifice with a common point that the fiber diameter reaches a nanoscale with the synergistic effect of spraying and stretching. The Chinese patent application of ZL201611005678.4, published on Nov. 11, 2016, "Multi-responsive controllable filtration electrostatic-spinning nanofiber film and preparation method thereof", disclosed a method comprising steps of: placing a thermo-sensitive pH-responsive polymer solution into an electrostatic spinning machine; and after being processed with spraying and laying in the electrostatic spinning machine, forming the nanofiber film. The key problem of the electrostatic spinning is that: the electrostatic spinning belongs to the spinning with negative stretching under no nipping. The electrostatic spray stream forms the Taylor cone during the filamentization process, and the spray stream for fibers is processed with insufficient drafting, which causes that: the macromolecules in the nanofibers have poor orientations; the nanofibers are required to be further attenuated; the strength is low and the size scale is required to be further decreased. Moreover, the filamentization process of the Taylor cone form causes that the fibers obtained through the electrostatic spinning are unable to be laid orderly and longitudinally, so that the spun fibers are difficult to be processed with linear collecting and gathering for being mainly applied in the production of the nanofiber film material. The Chinese patent application of ZL201610753443.7, published on Aug. 29, 2016, "Coaxial centrifugal spinning device and method", disclosed a centrifugal spinning method through arranging multiple layers of needles internally and externally on the coaxial centrifugal tube, so as to realize the high-speed rotation coaxial centrifugal tube for the scale production of the superfine fibers, and even realize the centrifugal spinning method of the nanofibers. The Chinese patent application of ZL201611154055.3, published on Dec. 14, 2016, "Titanium dioxide/polyvinylidene fluoride microfiber/nanofiber film and centrifugal spinning preparation method thereof", disclosed a method comprising steps of: mixing self-prepared anatase-type $TiO_2$ and polyvinylidene fluoride (PVDF), and preparing the centrifugal spinning solution; processing with centrifugal spinning on the centrifugal spinning machine; and forming the micro-nano fibrous film. The key problem of the centrifugal spinning is that: through spraying under the high-speed rotation centrifugal effect, the filaments formed through the spray stream are laid circularly, so that the spun fibers are difficult to be arranged orderly and longitudinally and collected and gathered linearly for being mainly applied in the production of the nanofiber film material. During the spinning process, the centrifugal spinning also belongs to the spinning with negative stretching under no nipping. The drafting force of the centrifugal spray stream is limited by factors such as the rotation speed and the air resistance, causing the insufficient drafting of spinning. The insufficient drafting causes that: the macromolecules in the nanofibers have the poor orientation degree; the nanofibers are required to be further attenuated; the strength is low and the size scale is required to be further decreased. However, the small diameter of the nanofibers leads to the low strength and abrasiveness of the nanofibers, so that the nanofibers easily abrade and fall off if being coated on the fabric surface and therefore the coated textile product has the poor functional durability, causing that the nanofibers can be lapped merely with a small amount to be processed into the nanofiber film and are unable to be processed with the conventional drafting and twisting for forming the yarn, which seriously limits the industrialized application of the nanofibers. If converting the nanofibers into macroscopic linear mass, the products such as the medical and functional clothing and the industrial fabrics of various types can be produced with the modern spinning means, which will break through the performance and value of the traditional textile products and has the wide application prospect. Thus, the insufficient drafting in the nano spinning production causes that: the macromolecules of the nano-spun fibers have poor orientations to weaken nanofibers; the nano-spun fibers are insufficiently attenuated due to poor drafting. The weakness of the nanofibers causes the poor abrasiveness and durability, so that the nanofibers easily abrade and fall off if being coated on the fabric surface and are unable to be processed by the conventional ring spinning, resulting in merely a small amount of the nanofibers applied in textile industrial production as non-woven fabrics or the nano films without large applications in common high speed textile processing.

In recent years, the production of the high-functionality high-quality yarn and fabric has been paid more and more attentions in the textile field. How to assign the high-functionality and the high-quality to the traditional textile yarn becomes the hot issue in the conventional textile processing. Since the nanofibers have many high-functionality and high-quality properties, if the nanofibers can be processed into the macroscopic yarn, the production problem of the scale high-speed textile processing of the nanofiber yarn can be solved and the products such as the medical and functional clothing and the industrial fabric of various types can be produced by the conventional spinning frames, which will break through the performance and value of the traditional textile products and has the wide application prospect. Currently, the processing of nano materials into the yarn is mainly reflected in trying the pure nano yarn processing technology. The Chinese patent application of ZL201310153933.X, published on Nov. 9, 2005, "Production and application of nanofiber yarn, band and plate", disclosed a method comprising steps of: adopting a banded or plate-shaped carbon nanotube array which is arranged in parallel; processing with drafting and twisting, and forming the nanofiber yarn. The obtained nanofiber band or yarn can be applied in fields of composite reinforcement organic polymer, electrode manufacturing, optical sensors and so on. The Chinese patent application of ZL201310454345.X, published on Sep. 27, 2013, "Oriented nanofiber yarn continuous preparation device and method", disclosed a method of directly processing the fibers prepared by the nanofiber spinning with twisting and winding for forming the linear material with the self-made rotation twisting device. However, the nanofibers have the thin shape dimension and the weak strength, and especially the carbon nanofibers have the feature of the high brittleness, causing that the fibers will be seriously damaged and destroyed after twisting the pure nanofibers into the yarn. According to the report, when twisting the nanofibers into the yarn, the nanofibers have many torsional fractures, so that the nanofibers cannot play the mechanical advantages, resulting in that the effect of the spun yarn is far lower than the expected theoretical effect. Based on the technical problems and bottlenecks of the pure nanofiber yarn, the Chinese patent application of ZL201210433332.X, published on Nov. 1, 2012, "Spinning device and spinning method for composite yarn of nanofibers and filaments", disclosed a method comprising steps of: introducing the filaments into two nanofiber receiving disks during electrostatic spinning, so that the nanofibers are adhered to the two filaments; then processing the two filaments covered with nanofibers by twisting and combining, and obtaining the filament/nanofiber composite yarn with the ultrahigh specific surface area of the nanofibers and the high strength characteristic of the filaments. Although the above application solves the difficult problem that the pure nanofibers are difficult to be spun into the yarn due to the weak strength, the above application merely involves processing the filaments and the nanofibers by twisting into the yarn, which just concerns very small-scale textile applications, as the conventional large-scale textile processing involves the natural chemical staple fiber spinning. Thus, the above application has the narrow processing application range, and fails to solve and realize the nano composite spinning production of the conventional staple fibers in the textile industrial field. Based on the above technical problems and bottlenecks, especially the technical production demands of the composite yarn made of the nanofibers and the conventional cotton fibers, the Chinese patent application of ZL201310586642.X, published on Nov. 20, 2013, "Preparation method of composite yarn blended with nanofibers", disclosed a method comprising steps of: during a carding process, directly spraying nanofibers into the output cotton web of the carding machine with the electrostatic nano spinning, and mixing with the cotton web to form the cotton/nanofiber sliver; then processing the cotton/nanofiber sliver into a roving for spinning to get a blended composite yarn. The above method seems to be easy, and effectively combines the nanofibers with the cotton fibers. However, the method has the problems of the inherent principles and practical production, and the key problem is that the nanofibers have the large specific surface area and have the strong adhesion and cohesion force with the conventional cotton fibers. In this case, during the drafting process of roving and spinning, the cotton fibers are difficult to freely and smoothly slide relative to each other, easily causing the problems of hooks, drafting difficulties and uneven drafting, finally resulting in that the yarn spun with twisting has the poor quality and fails to realize the production and processing of the high-functionality high-quality nanofiber composite yarn. The Chinese patent application of ZL201110221637.X, published on Aug. 4, 2011, "Method and system for preparing nanofiber coating on surface of yarn or fiber bundle", disclosed a method that: when the yarn passes between the spout of the spinning nozzle and the collector, the yarn surface is directly under the spraying effect of nanofiber spinning of the nozzle, and therefore a layer of nanofiber coating film is formed on the surface. Obviously, the above application belongs to the spraying method. The nanofibers fail to enter the yarn body and generate the good cohesion effect with the staple fibers inside the yarn, inevitably resulting in that the nanofiber coating layer separates from the yarn surface or falls off due to the abrasion in the subsequent use and processing, causing poor durability of the product. Through analyzing the above technologies, it can be known that: the insufficient drafting during the nanofiber production incurs poor orientations of macromolecules in the nanofibers to weaken nanofibers, and insufficient thickness attenuation, which causes the poor abrasiveness and durability, so that the nanofibers easily abrade and fall off if being coated on the fabric surface and are hard to be processed by the conventional ring spinning; if adopting the composite spinning with the conventional fibers through the electrostatic nano-spinning or the centrifugal spinning, the uniform mixing will cause the uneven and bad composite drafting and the difficulty of high-qualified yarn formation, the simple surface spraying coating cannot realize even distribution and effective cohesion of the composite nano-fibers and conventional micro-fibers, and the nanofibers easily abrade and fall off. Thus, the contradictory difficult problems of the composite yarn formation by combining nanofiber spinning and the conventional fiber spinning cause that: merely a small amount of the nanofibers can be processed into the non-woven fabric or the nano film in the textile industrial production and the nanofibers are still unable to be applied in the scale high-speed textile yarn processing production, which seriously limits the textile industrialized application of the nanofibers.

Different from the spinning process, the film forming process is to convert polymer materials into a sheet form and then wind into a roll. There are various processing methods for forming the plastic film, such as the rolling method, the casting method, the blow molding method and the stretching method. According to above methods, the plastic film production employs an external force to orientate and arrange the polymer inner chain or crystal in parallel to the film surface within an appropriate temperature range (high-elastic state) of above the glass transition temperature and below the melting point; then a film-like profile is formed. Subsequently, heat-setting is adopted for the tensioned film profile to fix the oriented macromolecular structure which is then cooled, pulled, and winded. During the process of film blow molding, according to different extrusion and traction directions, it can be divided into three types: flat blowing, up blowing and down blowing. There are also special blow molding methods such as up extruding up blowing. Film material has many special features: 1) the most basic performance of the film material is a flat appearance with clean surface and no dust or oil; 2) the thickness and length of the standard specifications are controllable, wherein the thickness can be as low as nanoscale, and the width can be precisely controlled at the macro millimeter scale, effectively ensuring the mechanical strength of the fiber film and precise stabilization of film shape size, so that the specifications of each film material deviations are in line with customer requirements; 3) for the transmittance and gloss according to customer requirements for different production, high transmittance may be maintained according to transmittance requirement, but the gloss must be maintained for bright and beautiful effects; 4) tensile strength, elongation at break, tearing strength, impact strength and so on are easy to achieve compliance; 5) according to use, application and performance, the processed film can have various shape sizes, different specifications of the meshes, cracks, etc., giving the film material excellent moisture permeability and air permeability; 6) size and chemical stability, as well as surface tension are easy to reach high standards. The widely used film materials have many types, such as polymer film material, aluminum film material, microporous film material, which are mainly used in the packaging of food, medicine and cosmetic products, the filter purification of air and water, the filtration of virus and dust, and so on. It can be seen that the conventional film is basically not used for the production of textile yarn and fabric, wherein the key issue is: the relatively stable film is difficult to be freely migrated and hugged together; therefore direct twisting of the film material cannot get the migration and coherence structure of conventional filaments and staple fiber spun yarns by twisting, leading to appearance and feel performance of the film spun yarn are quite different from that of conventional filaments and staple fiber spun yarns.

SUMMARY OF THE PRESENT INVENTION

The prior art has technical problems that: uniform blending and sufficient twisted coherence are difficult to get during the composite spinning using conventional staple fibers and filaments formed by a spinneret orifice spraying; sufficient migration and coherence are hard to achieve during the film twisting with itself as well as composite twisting with conventional staple fibers. In order to solve the above problems, the present invention provides a ring composite spinning method based on film filamentization. In order to accomplish the above object, the present invention provides following technical solutions.

A ring composite spinning method based on film filamentization comprises steps of: feeding staple fiber roving unwound from a roving package corresponding to each drafting system on a ring spinning machine into a drafting zone successively through a guide bar and a feed guider, wherein the drafting zone consists of a rear roller, a rear rubber roller, a middle-bottom roller, a middle-bottom apron, a middle-top roller, a middle-top apron, a front roller and a front rubber roller; drawing the staple fiber roving into flat ribbon-shaped staple fiber strands; outputting the staple fiber strands through a front roller nip which is formed by the front rubber roller engaging with the front roller, then entering a ring yarn formation twisting zone to be twisted to form ring staple yarn; respectively passing through a yarn pigtail guider, a ring and a traveler by the ring staple yarn and finally winding the ring staple yarn on a bobbin; wherein: a film cutting drafting device is arranged above each drafting system on the ring spinning machine; the film cutting drafting device consists of a bearing roller, an unwinding roller, a cutting roller, a filament drafting roller, a filament drafting rubber-covered roller and a heater; a cut-resistant apron is wrapped onto the unwinding roller; circular cutters are arranged on a circumference of the cutting roller in parallel; the cut-resistant apron corresponds to cutting edges of circular cutters on the cutting roller; a cutting zone is formed between the cut-resistant apron and the cutting roller; the filament drafting roller is located below the filament drafting rubber-covered roller; the filament drafting roller engages with the filament drafting rubber-covered roller to form a filament drafting roller nip; a middle vertical plane of a filament drafting roller nip line overlaps with a middle vertical plane of the cutting zone and a middle vertical plane of a front roller nip line; a first filament drafting zone is formed between the filament drafting roller nip and the cutting zone; a second filament drafting zone is formed between the filament drafting roller nip and the front roller nip; the heater is arranged in the second filament drafting zone; and, a heating groove of the heater is parallel with the filament drafting roller nip line and the front roller nip line;

during composite-spinning, by a film material unwound from a film material package arranged between the bearing roller and the unwinding roller, entering the cutting zone formed between the cut-resistant apron and the cutting roller through the unwinding roller; cutting and fiberizing the film material by the circular cutters to form uniformly-spread ribbon-shaped multi-filaments; after being outputted from the cutting zone, the ribbon-shaped multi-filaments entering the first filament drafting zone to get a primary drawing; after the primary drawing, the ribbon-shaped multi-filaments outputted from the filament drafting roller nip entering the second filament drafting zone, wherein the ribbon-shaped multi-filaments heated in the heating groove of the heater get a secondary drawing; after the secondary drawing, the ribbon-shaped multi-filaments outputted from the front roller nip entering the ring yarn formation twisting zone to converge together with the flat ribbon-shaped staple fiber strands outputted from the drafting zone of the ring spinning machine; combining and twisting to form a composite yarn; subsequently passing through the yarn pigtail guider, the ring and the traveler successively by the composite yarn, and finally winding the composite yarn onto the bobbin.

The cut-resistant apron is made of ultrahigh strength polyethylene, aramid, or ultrahigh strength rubber.

A distance between the cutting edges of the neighboring circular cutters is ranged from 0.1 mm to 0.3 mm.

Through adopting the above technical solutions, compared with prior art, the ring composite spinning method based on the film filamentization provided by the present invention has following advantages: One film cutting drafting device is arranged above each drafting system on the ring spinning machine, whose cut-resistant apron and the cutting roller engage with each other to form a cutting zone, wherein the film material is cut and fiberized to form ribbon-shaped multi-filaments which are uniformly spread and distributed for subsequent drawing and spinning, which changes the conventional way of producing filament fibers via linear extruding materials through the spinneret orifices, overcomes such problems as process flow lengthiness, equipment complexity during the conventional way of filament production. Then the ribbon-shaped multi-filaments generated through fiberization successively pass through the first filament drafting zone and the second filament drafting zone in sequence to conduct the primary, secondary drawings respectively for attenuation, resulting in each filament thickness changing from micrometer scale to micro-nano scale, from micro-nano scale to nanometer scale, and from nanometer scale to even smaller scale. Meanwhile, the inner molecular orientation and crystallization of the filaments are improved, and the filaments strength is increased, so that uniform and consistent high-yield output of the micro-nano filaments is quickly achieved, so as to avoid the conventional nano-spinning route such as electro-spinning and centrifugal spinning. Therefore, a series of technical problems that "insufficient drafting of filaments during the conventional nano-spinning incurs poor orientation of the macromolecules in the nano-fibers, unsatisfactory fineness of the nano-fibers, low strength of the nano-fibers, poor adhesion and durability of the nano-fibers; therefore, nano-fibers overlaying onto the fabric surface are very easy to be worn off, and nano-fiber strands fail to be spun into a yarn by conventional ring spinning" are solved. The attenuated ribbon-shaped filaments and the staple fiber strands after being drawn through the ring drafting zone are outputted from the front roller nip and enter the ring yarn formation twisting zone to be twisted together into a composite yarn. When the ribbon-shaped filaments and the flat ribbon-shaped staple fiber strands are overlapped, combined and twisted, the nano-micro filaments at a middle position of the ribbon-shaped multi-filaments and the staple fiber strands uniformly mix and wind together to form the composite yarn body, and the nano-micro filaments at two sides of the ribbon-shaped multi-filaments are exposed and compactly wrapped onto the surface layer of the composite yarn body, so as to form the high-functionality high-quality composite yarn with the inner structure having the uniform mixture and full coherence between the nano-micro filaments and the conventional staple fibers and the surface structure having the compact wrapping and full exposure of nano-micro filaments. Therefore, filamentization and attenuation of the film material are rapidly realized; one-step production of filament/staple-fiber composite yarn using the film material and conventional staple fibers is also realized, effectively integrating the film industry and the textile and garment industry as functional films can be directly used to produce textile yarns of fibers in a high-speed and high-efficient way. Therefore, the present invention takes in film materials as the expanded textile raw materials, and breaks limits of "conventional nano-spinning producing nano-fibers in low bulk and low-speed unable to meet the textile industrial application requirements", which provides an effective method for functional films to be used in the production and processing of composite yarn and apparel fabrics. The method of the present invention is convenient to operate and is easy to be popularized and applied widely.

DETAILED DESCRIPTION OF THE PREFERRED EMBODIMENT

A ring composite spinning method based on film filamentization provided by the preferred embodiments of the present invention is further described in detail with accompanying drawings as follows.

Figure 1:
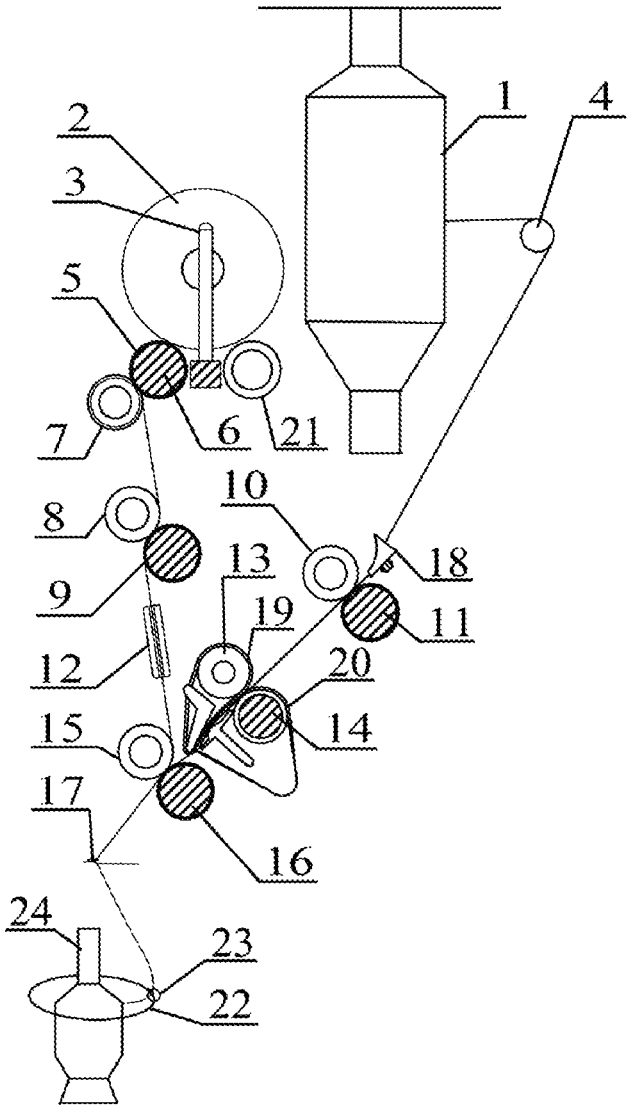
FIG. 1 is a sketch view of working principles of a ring composite spinning method based on film filamentization according to preferred embodiments of the present invention.
Figure 2:
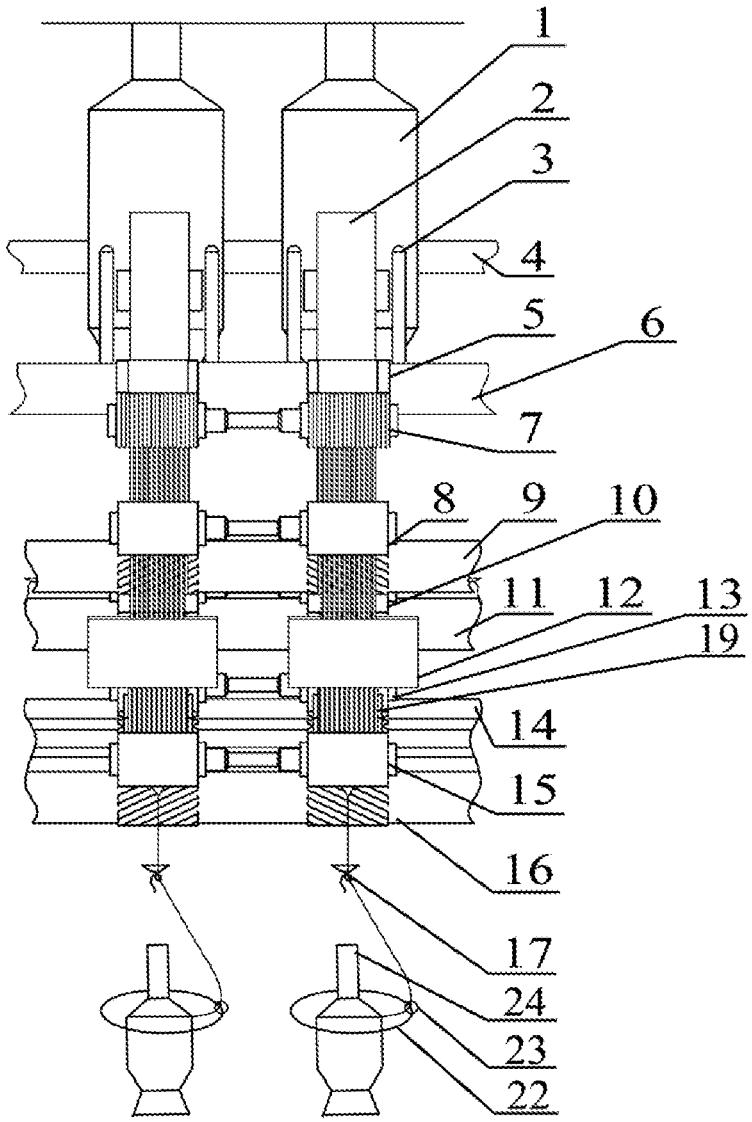
FIG. 2 is a sketch view of an operation state of a film cutting drafting device according to the preferred embodiments of the present invention.

Referring to FIG. 1 and FIG. 2, a ring composite spinning method based on film filamentization comprises steps of: feeding staple fiber roving unwound from a roving package 1 corresponding to each drafting system on a ring spinning machine into a drafting zone successively through a guide bar 4 and a feed guider 18, wherein the drafting zone consists of a rear roller 11, a rear rubber roller 10, a middle-bottom roller 14, a middle-bottom apron 20, a middle-top roller 13, a middle-top apron 19, a front roller 16 and a front rubber roller 15; drawing the staple fiber roving into flat ribbon-shaped staple fiber strands; outputting the staple fiber strands through a front roller nip which is formed by the front rubber roller 15 engaging with the front roller 16, and then entering a ring yarn formation twisting zone; wherein: a film cutting drafting device is arranged above each drafting system on the ring spinning machine; the film cutting drafting device consists of a bearing roller 21, an unwinding roller 6, a cutting roller 7, a filament drafting roller 9, a filament drafting rubber-covered roller 8 and a heater 12; isolation bars 3 are arranged between the bearing roller 21 and the unwinding roller 6; each pair of the isolation bars 3 correspond to the front rubber roller 15 of each drafting system of the spinning machine; each film material unwound from corresponding film material package 2 with effective limited positions smoothly enters the corresponding front roller nip of the spinning machine; a cut-resistant apron 5 is arranged on the unwinding roller 6, wherein the cut-resistant apron 5 is made of an elastic cut-resistant material such as ultrahigh strength polyethylene, aramid or ultrahigh strength rubber; circular cutters are arranged on a circumference of the cutting roller 7 in parallel; a distance between cutting edges of the neighboring circular cutters is ranged from 0.1 mm to 0.3 mm; the smaller the distance between the cutting edges of the neighboring circular cutters, the finer the mono-filaments formed after cutting and drawing; the cut-resistant apron 5 corresponds to the cutting edge of each circular cutter on the cutting roller 7; a cutting zone is formed between the cut-resistant apron 5 and the cutting roller 7; the filament drafting roller 9 is located below the filament drafting rubber-covered roller 8; the filament drafting roller 9 engages with the filament drafting rubber-covered roller 8 to form a filament drafting roller nip; a middle vertical plane of a filament drafting roller nip line overlaps with a middle vertical plane of the cutting zone and a middle vertical plane of a front roller nip line; a first filament drafting zone is formed between the filament drafting roller nip and the cutting zone; a second filament drafting zone is formed between the filament drafting roller nip and the front roller nip; the heater 12 is arranged in the second filament drafting zone; a heating groove of the heater 12 is parallel with the filament drafting roller nip line and the front roller nip line; the heater 12 can adopt an ironing spinning device disclosed in Chinese patent publication of CN201245734Y, published on May 27, 2009, or other forms of heating devices with a heating structure such as a resistance wire; and, when adopting an iron spinning device, the heater 12 is externally connected to a 24-36V low-voltage safety power supply through wires.

During composite-spinning, the film material package 2 is arranged between the bearing roller 21 and the unwinding roller 6 and between one pair of the isolation bars 3, that is to say one isolation bar 3 is arranged at each of two sides of the film material package 2. The film material is organic polymer film material, inorganic film material or organic-inorganic mixed film material, and the film material has a width smaller than a width of the cutting zone and a thickness less than or equal to 1 mm. The thinner the film material, the finer each filament in the ribbon-shaped multi-filaments formed through cutting fiberization. The heater 12 is externally connected with the safety source through the wires, so as to heat an inner wall surface of the heating groove of the heater 12 to 60-240° C. When the film material is the inorganic or the organic-inorganic mixed film material, the heater 12 is not heated, or the internal walls of the heating grooves of the heater 12 are only heated to 60° C., merely for facilitating each filament in the ribbon-shaped multi-filaments after the film filamentization being fully stretched. When the film material is an organic polymer film material with an obvious glass-transition temperature, the thicker the film material and the higher the glass-transition temperature of the film material, the higher the heating temperature; the thinner the film material and the lower the glass-transition temperature, the lower the heating temperature. The film material unwound from the film material package 2 between the bearing roller 21 and the unwinding roller 6 enters the cutting zone formed between the wear-resistant apron 5 and the cutting roller 7 through the unwinding roller 6; in the cutting zone, the circular cutters cut and fiberize the film material to form uniformly-spread ribbon-shaped filaments, which effectively achieves the filamentization of the film material. After being outputted through the cutting zone, the ribbon-shaped filaments enter the first filament drafting zone to get a primary drawing therein, so that the multi-filaments are primarily drafted and stretched, which prepares for high drafting of the multi-filaments; after the primary drawing, the ribbon-shaped multi-filaments are outputted from the filament drafting roller nip, then enter the second filament drafting zone wherein the ribbon-shaped multi-filaments heated in the heating groove of the heater 12 get a secondary drawing, wherein the inner consolidation structure of the polymer filaments with the obvious glass transition temperature is loosened, so that each filament of the multi-filaments is completely in the high-elastic state, as a result that the filaments become further attenuated and get inner molecular orientation and crystallization further improved, increasing the strength of the filaments and quickly achieving uniform and consistent high-yield output of the nano-filaments, so as to avoid the conventional nano-spinning route such as electro-spinning and centrifugal spinning. Therefore, a problem that "insufficient drafting of filaments during the conventional nano-spinning incurs poor orientation of the macromolecules in the nano-fibers, unsatisfactory fineness of the nano-fibers, low strength of the nano-fibers, poor adhesion and durability of the nano-fibers; therefore, nano-fibers overlaying onto the fabric surface are very easy to be worn off, and nano-fiber strands fail to be spun into a composite yarn by conventional ring spinning" is solved; after the secondary drawing, the ribbon-shaped multi-filaments outputting from the front roller nip enter the ring yarn formation twisting zone to converge together with the flat ribbon-shaped staple fiber strands outputted from the drafting zone of the ring spinning machine, being combined and twisted to form a composite yarn. The specific combination and yarn forming during the above process is described as follows. The ribbon-shaped multi-filaments after the secondary drawing are fed into the front roller nip, wherein the ribbon-shaped multi-filaments have a spread width larger than the staple fiber strands. The filaments at the middle position of the ribbon-shaped multi-filaments overlap with the flat ribbon-shaped staple fiber strands at the front roller nip and are uniformly combined to form the composite strands. The filaments at the two sides of the ribbon-shaped multi-filaments are outputted together with the composite strands through the front roller nip and then enter the ring yarn formation twisting zone. In the ring yarn formation twisting zone, the filaments at the middle position of the ribbon-shaped multi-filaments are combined and twisted with staple fibers in the composite strands to form the composite yarn body in which filaments and staple fibers perform sufficient migrations and even blending so as to form the high-functionality high-quality composite yarn with the inner structure having the uniform mixture and full coherence between the nano-micro filaments and the conventional staple fiber; meanwhile, the mono-filaments at the two sides of the ribbon-shaped multi-filaments effectively protect and capture the staple fibers of the composite strands during the twisting process to max the usage of staple fibers. Thereafter, the fiber ends exposed at the surface of the composite yarn are effectively wrapped at the composite yarn surface with tightly fastening by filaments, so as to from the surface structure having the compact wrapping and full exposure of nano-micro filaments. Therefore, a yarn layered structure is realized that: the yarn body is formed through twisting the nano-micro filaments and the conventional staple fibers after uniformly mixing and fully cohering; and the nano-micro filaments fully wrap the outer layer of the yarn body for capturing the conventional fibers and showing the function of the nano-micro filaments. The yarn layered structure effectively solves the technical problems that: for composite spinning with filaments formed through spraying by the spinneret orifice and conventional staple fibers, and composite spinning with the nanofibers formed through spinning spraying and the conventional staple fibers, it is difficult to uniformly mix and fully cohere and twist; and when twisting the various film materials or composite-twisting the film material with the conventional staple fibers, it is difficult to get sufficient fiber migrations and coherence. The composite yarn passes through the yarn pigtail guider 17, the ring 22 and the traveler 23, and is finally wound onto the yarn bobbin 24. According to the method provided by the present invention, one-step production of filament/staple-fiber composite yarn using the film material and conventional staple fibers is rapidly realized through the film filamentization, attenuation and blended twisting. The direct feeding of functional films can complete the highly-efficient composite spinning with the conventional staple fibers, so as to obtain the high-functionality high-quality yarn for textile, which effectively integrates the film industry and the textile and garment industry. Therefore, the present invention takes in film materials as the expanded textile raw materials, and breaks limits of "conventional nano-spinning producing nano-fibers in low bulk and low-speed unable to meet the textile industrial application requirements", which provides an effective method for functional films to be used in the production and processing of composite yarn and apparel fabrics. The method of the present invention is convenient to operate and is easy to be popularized and applied widely.

The specific application of the present invention is further illustrated in detail with the following ring composite spinning process based on the filamentization of various film materials.

First Preferred Embodiment

To form a yarn by composite twisting of cotton fibers and polyamide (nylon) porous film after filamentization The film material used is the polyamide porous film, having a width of 15 mm and a thickness of 0.1 mm. The cut-resistant apron 5 is made of high-strength polyethylene cut-resistant material. The distance between the cutting edges of the neighboring circular cutters on the circumference of the cutting roller 7 is 0.1 mm. The heater 12 is externally connected with the safety source of 24 V through the wire, and the inner wall surface of the heating groove of the heater 12 is heated to 150° C. The formed film material package 2 of the polyamide porous film is arranged between the bearing roller 21 and the unwinding roller 6. The film material unwound from the film material package 2 enters the cutting zone formed between the cut-resistant apron 5 and the cutting roller 7 through the unwinding roller 6, and is cut and fiberized into uniformly-spread ribbon-shaped multi-filaments. After being outputted through the cutting zone, the ribbon-shaped multi-filaments successively enter the first filament drafting zone and the second filament drafting zone. In the first filament drafting zone, the multi-filaments are processed with the primary drawing with a drafting ratio of 1.03. In the second filament drafting zone, the multi-filaments are heated with a temperature of 150° C. in the heating groove in the second filament drafting zone, so that the internal macromolecules of each filament in the ribbon-shaped multi-filaments are at a high-elastic state and the inner molecular reinforcement structure of the polyamide filaments becomes loosened; and then the filaments are processed with a high-ratio drafting, namely the secondary drawing, with a drafting ratio of 35. The ribbon-shaped multi-filaments after the secondary drawing are fed into the front roller nip. The roving adopts 385Tex cotton roving. The cotton roving unwound from the roving package 1 is drafted with a drafting ratio of 55 through the drafting system of the spinning machine and forms the flat ribbon-shaped staple fiber strands. The staple fiber strands enter the front roller nip. The width of the ribbon-shaped multi-filaments is larger than that of the staple fiber strands. The filaments at the middle position of the ribbon-shaped filaments overlap with the flat ribbon-shaped staple fiber strands at the front roller nip, and then are uniformly mixed and combined to form the composite strands. The filaments at the two sides of the ribbon-shaped multi-filaments are distributed at the two sides of the composite strands and are outputted together with the composite strands through the front roller nip, and then enter the ring yarn formation twisting zone. In the ring yarn formation twisting zone, the filaments at the two sides of the ribbon-shaped multi-filaments combine with the composite strands and are twisted together to form a composite yarn. The spun composite yarn passes through the yarn pigtail guider 17, the ring 22 and the traveler 23, and is finally wound on the bobbin 24. The original nylon porous film has the strength of 20.0 cN; and the yarn obtained merely through spinning the cotton roving without feeding the nylon porous film has the strength of 148.7 cN, the elongation at break of 5.0%, the yarn levelness CVm % of 14.9 and the USTER yarn hairiness H value of 5.8. According to the present invention, the yarn obtained through the composite spinning with cotton fibers and the nylon porous film after the filamentization has the strength of 228.1 cN, the elongation at break of 7.2%, the yarn levelness CVm % of 12.2 and the USTER yarn hairiness H value of 2.3. It can be seen that the composite yarn has a high quality. A polyamide filament is unwound from the inner of the composite yarn body, and the size thereof is observed with the optical microscope. The results show that: the filament is in a branched continuous long and thin shape and has a fineness of 926 nm, which realizes the composite yarn forming with the nano-micro superfine polyamide muti-filaments and the conventional staple fibers. Because part of the nano-micro superfine polyamide filaments are exposed and wrapped on the surface of the composite yarn body, compared with the surface of the conventional cotton textile fabrics, the surface of the fabric made by the composite yarn provided by the present invention has functions of water repellency and abrasive resistance.

Second Preferred Embodiment

To form a yarn by composite twisting of wool fibers and polysulfone (PSF) nanofiber film after filamentization The film material used is the PSF nanofiber film with a nanofiber fineness of 400-600 nm, belonging to the thermoplastic nanofiber film material. The film material has a width of 20 mm and a thickness of 0.1 mm. The cut-resistant apron 5 is made of aramid material. The distance between the cutting edges of the neighboring circular cutters on the circumference of the cutting roller 7 is 3 mm. The heater 12 is externally connected with the safety source of 36 V through the wire, and the inner wall surface of the heating groove of the heater 12 is heated to 240° C. The formed film material package 2 of the PSF nanofiber film is arranged between the bearing roller 21 and the unwinding roller 6. The film material unwound from the film material package 2 enters the cutting zone formed between the cut-resistant apron 5 and the cutting roller 7 through the unwinding roller 6, and is cut and fiberized into uniformly-spread ribbon-shaped multi-filaments. After being outputted through the cutting zone, the ribbon-shaped multi-filaments successively enter the first filament drafting zone and the second filament drafting zone. In the first filament drafting zone, the filaments are processed with the primary drawing with a drafting ratio of 1.05. In the second filament drafting zone, the filaments are heated with a temperature of 240° C. in the heating groove in the second filament drafting zone, so that the internal macromolecules of each mono-filament in the ribbon-shaped multi-filaments are at a high-elastic state and the inner molecular reinforcement structure of the PSF nanofibers becomes loosened; and then the filaments are processed with a high-ratio drafting, namely the secondary drawing, with a drafting ratio of 6. The ribbon-shaped filaments after the secondary drawing are fed into the front roller nip. The roving adopts 305Tex wool roving. The wool roving unwound from the roving package 1 is drafted with a drafting ratio of 35 through the drafting system of the spinning machine and forms the flat ribbon-shaped staple fiber strands. The staple fiber strands enter the front roller nip. The width of the ribbon-shaped multi-filaments is larger than that of the staple fiber strands. The filaments at the middle position of the ribbon-shaped multi-filaments overlap with the flat ribbon-shaped staple fiber strands at the front roller nip, and then are uniformly mixed and combined to form the composite strands. The filaments at the two sides of the ribbon-shaped multi-filaments are distributed at the two sides of the composite strands and are outputted together with the composite strands through the front roller nip, and then enter the ring yarn formation twisting zone. In the ring yarn formation twisting zone, the filaments at the two sides of the ribbon-shaped multi-filaments combine with the composite strands and are twisted together to form a composite yarn. The spun composite yarn passes through the yarn pigtail guider 17, the ring 22 and the traveler 23, and is finally wound on the bobbin 24. The original PSF nanofiber film has the strength of 12.0 cN; and the yarn obtained merely through spinning the wool roving without feeding the PSF nanofiber film has the strength of 157.2 cN, the elongation at break of 7.9%, the yarn levelness CVm % of 15.1 and the USTER yarn hairiness H value of 6.2. According to the present invention, the yarn obtained through the composite spinning with wool fibers and the PSF nanofiber film after the filamentization has the strength of 224.3 cN, the elongation at break of 8.7%, the yarn levelness CVm % of 13.6 and the USTER yarn hairiness H value of 2.2. It can be seen that the composite yarn has a high quality. A PSF filament is unwound from the inner of the composite yarn body, and the size thereof is observed with the optical microscope. The results show that: the single PSF filament is in a meshed continuous long and thin shape, and has a width of about 1.0 mm and a width of 0.04 mm; and moreover, the nanofibers in the filament have a fineness distributed in a range of 97-178 nm, which realizes the composite yarn forming with the nanofibers and the conventional fibers. Because part of the PSF filaments are exposed and wrapped on the surface layer of the composite yarn body, compared with the surface of the corresponding conventional wool textile fabrics, the surface of the fabric made by the composite yarn provided by the present invention has functions of softness, water repellence and self-cleaning.

Third Preferred Embodiment

To form a yarn by composite twisting of ramie fibers and inorganic copper film after filamentization The film material is the copper film, having a width of 10 mm and a thickness of 0.06 mm. The cut-resistant apron 5 is made of ultrahigh strength rubber. The distance between the cutting edges of the neighboring circular cutters on the circumference of the cutting roller 7 is 1 mm. The heater 12 is externally connected with the safety source of 36 V through the wire, and the inner wall surface of the heating groove of the heater 12 is heated to 60° C. The formed film material package 2 of the copper film is arranged between the bearing roller 21 and the unwinding roller 6. The film material unwound from the film material package 2 enters the cutting zone formed between the cut-resistant apron 5 and the cutting roller 7 through the unwinding roller 6, and is cut and fiberized into uniformly-spread ribbon-shaped multi-filaments. After being outputted through the cutting zone, the ribbon-shaped multi-filaments successively enter the first filament drafting zone and the second filament drafting zone. In the first filament drafting zone, the multi-filaments are processed with the primary drawing with a drafting ratio of 1.05. In the second filament drafting zone, the multi-filaments are heated with a temperature of 60° C. in the heating groove at the second filament drafting zone. Although the inner structure of the copper material does not become loosened, stretching and drawing of each filament in the ribbon-shaped multi-filaments are facilitated. Thereafter, the multi-filaments are processed with the secondary drawing, with a drafting ratio of 1.05. The ribbon-shaped filaments after the secondary drawing are fed into the front roller nip. The roving adopts 470Tex ramie fiber roving. The ramie fiber roving unwound from the roving package 1 is drafted with a drafting ratio of 24.85 through the drafting system of the spinning machine and forms the flat ribbon-shaped ramie fiber strands. The staple fiber strands enter the front roller nip. The width of the ribbon-shaped multi-filaments is larger than that of the ramie fiber strands. The filaments at the middle position of the ribbon-shaped multi-filaments overlap with the flat ribbon-shaped ramie fiber strands at the front roller nip, and then are uniformly mixed and combined to form the composite strands. The filaments at the two sides of the ribbon-shaped multi-filaments are distributed at the two sides of the composite strands and are outputted together with the composite strands through the front roller nip, and then enter the ring yarn formation twisting zone. In the ring yarn formation twisting zone, the filaments at the two sides of the ribbon-shaped multi-filaments combine with the composite strands and are twisted together to form a composite yarn. The spun composite yarn passes through the yarn pigtail guider 17, the ring 22 and the traveler 23, and is finally wound on the bobbin 24. The original copper film has the strength of 127.3 cN; and the yarn obtained merely through spinning the ramie roving without feeding the copper film has the strength of 257.2 cN, the elongation at break of 5.4%, the yarn levelness CVm % of 19.7 and the USTER yarn hairiness H value of 11.6. According to the present invention, the yarn obtained through composite-spinning with the copper film after filamentization and the ramie roving has the strength of 467.2 cN, the elongation at break of 6.8%, the yarn levelness CVm % of 17.1 and the USTER yarn hairiness H value of 4.2. Thus, it can be seen that the composite yarn has a high quality. A copper filament is unwound from the inner of the composite yarn body, and then the size and morphology thereof are observed with the optical microscope. The results show that: the single copper filament is in a ribbon-shaped continuous long and thin shape, and has a width of about 0.75 mm and a thickness of about 0.05 mm. Because part of the copper filaments are exposed and wrapped on the surface layer of the composite yarn body, compared with the surface of the conventional ramie textile fabrics, the surface of the fabric made by the composite yarn provided by the present invention has functions of electric conduction and electromagnetic wave shielding.

What is claimed is:

1. A ring composite spinning method based on film filamentization, comprising steps of: feeding staple fiber roving unwound from a roving package (1) corresponding to each drafting system on a ring spinning machine into a drafting zone successively through a guide bar (4) and a feed guider (18), wherein the drafting zone consists of a rear roller (11), a rear rubber roller (10), a middle-bottom roller (14), a middle-bottom apron (20), a middle-top roller (13), a middle-top apron (19), a front roller (16) and a front rubber roller (15); drawing the staple fiber roving into flat ribbon-shaped staple fiber strands; outputting the staple fiber strands through a front roller nip which is formed by the front rubber roller (15) engaging with the front roller (16), then entering a ring yarn formation twisting zone to be twisted to form ring staple yarn; respectively passing through a yarn pigtail guider (17), a ring (22) and a traveler (23) by the ring staple yarn, and finally winding the ring staple yarn on a bobbin (24); wherein: a film cutting drafting device is arranged above each drafting system on the ring spinning machine; the film cutting drafting device consists of a bearing roller (21), an unwinding roller (6), a cutting roller (7), a filament drafting roller (9), a filament drafting rubber-covered roller (8) and a heater (12); a cut-resistant apron (5) is wrapped onto the unwinding roller (6); circular cutters are arranged on a circumference of the cutting roller (7) in parallel; the cut-resistant apron (5) corresponds to cutting edges of the circular cutters on the cutting roller (7); a cutting zone is formed between the cut-resistant apron (5) and the cutting roller (7); the filament drafting roller (9) is located below the filament drafting rubber-covered roller (8); the filament drafting roller (9) engages with the filament drafting rubber-covered roller (8) to form a filament drafting roller nip; a middle vertical plane of a filament drafting roller nip line overlaps with a middle vertical plane of the cutting zone and a middle vertical plane of a front roller nip line; a first filament drafting zone is formed between the filament drafting roller nip and the cutting zone; a second filament drafting zone is formed between the filament drafting roller nip and the front roller nip; the heater (12) is arranged in the second filament drafting zone; and, a heating groove of the heater (12) is parallel with the filament drafting roller nip line and the front roller nip line;

during composite-spinning, by a film material unwound from a film material package (2) arranged between the bearing roller (21) and the unwinding roller (6), entering the cutting zone formed between the cut-resistant apron (5) and the cutting roller (7) through the unwinding roller (6); cutting and fiberizing the film material by the circular cutters to form uniformly-spread ribbon-shaped multi-filaments; after being outputted from the cutting zone, the ribbon-shaped multi-filaments entering the first filament drafting zone to get a primary drawing; after the primary drawing, the ribbon-shaped multi-filaments outputted from the filament drafting roller nip entering the second filament drafting zone, wherein the ribbon-shaped multi-filaments heated in the heating groove of the heater (12) get a secondary drawing; after the secondary drawing, the ribbon-shaped multi-filaments outputted from the front roller nip entering the ring yarn formation twisting zone to converge together with the flat ribbon-shaped staple fiber strands outputted from the drafting zone of the ring spinning machine, wherein the ribbon-shaped multi-filaments have a spread width larger than the staple fiber strands; combining and twisting filaments at a middle position of the ribbon-shaped multi-filaments with the staple fiber strands to form a composite yarn body, and wrapping filaments at two sides of the ribbon-shaped multi-filaments onto a surface layer of the composite yarn body to protect and capture the staple fiber strands, in such a manner that a composite yarn is formed; subsequently passing through the yarn pigtail guider (17), the ring (22) and the traveler (23) successively by the composite yarn, and finally winding the composite yarn onto the yarn bobbin (24).

2. The ring composite spinning method based on the film filamentization, as recited in claim 1, wherein the cut-resistant apron (5) is made of polyethylene sufficient to interact with the circular cutters, aramid, or rubber sufficient to interact with the circular cutters.

3. The ring composite spinning method based on the film filamentization, as recited in claim 1, wherein a distance between cutting edges of adjacent circular cutters is ranged from 0.1 mm to 3 mm.

* * * * *